US005826990A

United States Patent [19]

Suzuki et al.

[11] Patent Number: 5,826,990

[45] Date of Patent: Oct. 27, 1998

[54] METHOD AND DEVICE FOR LIMITING A NUMBER OF TIMES EACH PRINT HAMMER IS DRIVEN DURING A PREDETERMINED PERIOD OF TIME

[75] Inventors: Toshiyuki Suzuki; Masami Iwama; Kohichi Yageta; Mitsuru Kawakami, all of Hitachinaka, Japan

[73] Assignee: Hitachi Koki Co., Ltd., Tokyo, Japan

[21] Appl. No.: 933,967

[22] Filed: Sep. 19, 1997

[30] Foreign Application Priority Data

Sep. 19, 1996 [JP] Japan ..... 8-247596

[51] Int. Cl.[6] ..... B41J 29/38

[52] U.S. Cl. ..... 400/124.13; 400/54

[58] Field of Search ..... 400/54, 74, 120.14, 400/120.15, 124.13, 323

[56] References Cited

U.S. PATENT DOCUMENTS 4,271,414 6/1981 Williams et al. ..... 400/120.15
4,284,876 8/1981 Ishibashi et al. ..... 400/120.15
4,540,295 9/1985 Okunishi et al. ..... 400/323
4,653,940 3/1987 Katsukawa ..... 400/54
5,152,619 10/1992 Niikawa et al. ..... 400/54
5,458,424 10/1995 Kato et al. ..... 400/323
5,662,421 9/1997 Hagiwara et al. ..... 400/54

*Primary Examiner*—Edgar S. Burr
*Assistant Examiner*—Steven S. Kelley
*Attorney, Agent, or Firm*—Whitham, Curtis & Whitham

[57] ABSTRACT

To prevent effective print speed from being lowered, a counter is provided for each of a plurality of print hammers. A number of times a print hammer is driven during one print phase having a predetermined period of time is counted by the counter. The counted value is compared with a reference value, and when the counted value has reached the reference value during the print phase, driving of the print hammer is halted until the end of the print phase. A reference value is changed based on the number of times the print hammer is driven during a previous print phase immediately before the present print phase. The reference value represents an allowable number the print hammer can be driven during each of successive print phases.

13 Claims, 3 Drawing Sheets

METHOD AND DEVICE FOR LIMITING A NUMBER OF TIMES EACH PRINT HAMMER IS DRIVEN DURING A PREDETERMINED PERIOD OF TIME

BACKGROUND OF THE INVENTION

1. Field of the Invention

The present invention relates generally to a printing device of the type in which a plurality of print hammers are selectively driven to make an impression of dot. More particularly, the invention relates to a method and device for limiting a number of times each of a plurality of print hammers is driven during a predetermined period of time.

2. Description of the Prior Art

Conventionally, there has been known a printing device including a hammer bank which is reciprocal with forward and backward movements along a print line. The hammer bank includes a plurality of print hammers juxtaposed along the print line. During the reciprocal movements of the hammer bank, the print hammers, are selectively driven to make an impression of dot on a print medium.

In the conventional printing device of the type described above, when a particular hammer is continuously driven, the associated hammer coil generates heat, causing the service life of hammer components to shorten. To prevent such an occurrence, a print control system shown In FIG. 1 has been conventionally used.

In the print control system shown in FIG. 1, a counter 4 receives print data from a print controller 1 and counts a number of times n each hammer Is driven during a predetermined period of time measured by a timer 7. A comparator 5 connected to the output of the counter 4 compares the number of times n the hammer is driven with a reference number M that is latched in a data latch circuit 8. The reference number 4 represents an allowable number the print hammer can be driven during each of successive print phases. The reference number M is determined so as not to shorten the service life of hammer components caused by heat generated by the associated hammer coil. When the comparison output indicates that the number of times n the hammer is driven during a print phase has reached the reference number M, i.e., n=M, then a print halting unit 6 initializes the counted number In the counter 4 so as to be n=0 and also sends a print stop signal to a hammer controller 2 so that the hammer 3 is not driven until the end of the print phase, that is, expiration of the predetermined period of time measured by the timer 7.

When the comparison output from the comparator 5 indicates that the number of times n the hammer is driven has not reached the reference number M during the print phase which continues for the predetermined period of time, i.e., n<M, the hammer is driven in accordance with the print data. In this case, after expiration of the predetermined period of time, the print halting unit 6 initializes the counted number in the counter 4 so as to be n–0.

SUMMARY OF THE INVENTION

The present invention has been made to solve problems involved in the conventional print limiting device.

The conventional print limiting device may operate as follows. As shown in the timing chart of FIG. 2, when the number of times n the hammer is driven during the first print phase which continues for a predetermined period of time T1 has reached the reference number M, driving of the hammer is halted until the start of the following print phase which also continues for the same predetermined period of time T1' (T1=T1'), In the case shown in FIG. 2, the number of times n the hammer is driven during the second print phase has also reached the reference number M, so that driving of the same hammer is also halted until the start of third print phase which also continues for the same predetermined period of time.

In the timing chart of FIG. 3, the number of times n the hammer is driven has not reached the reference number M during the first print phase. Thus, the hammer is allowed to perform printing until the end of the first print phase, that is, until just before the start of the second print phase. However, in the case of FIG. 3, the number of times n the hammer is driven during the second print phase has reached the reference number M during the second print phase. Therefore, driving of that hammer is halted until the end of the second print phase.

In the timing chart of FIG. 4, during the first print phase, the hammer is not driven. Therefore, printing is not performed. In the second print phase, the number of times n the hammer is driven has reached the reference number M, driving of the hammer is halted until the start of the third print phase.

As described above, the conventional print controlling system counts the number of times each print hammer is driven during a predetermined period of time. When the count value n has reached the reference number M, printing is halted until the start of the following print phase.

In the print pattern shown in FIG. 3, printing is halted when the number of times the print hammer is driven has reached (M–1)+M during a period of time T1+T2. That is, the print pattern in FIG. 3 represents the limit in which the hammer components can be continuously used. On the other hand, in the print pattern shown in FIG. 4, printing is halted when the number of times the print hammer is driven has reached the reference number M during the same period of time, T1+T2. That is, in the case of FIG. 4. printing is forcibly halted irrespective of the fact that the hammer components have potential capability to continue printing. Stopping printing for the print pattern shown in FIG. 4 lowers effective printing speed in the printing device incorporating the print controlling system shown in FIG. 1.

In view of the foregoing, it is an object of the present invention to minimize lowering of the effective printing speed with a print control in which hammer components are used to show their maximum operational limit.

To achieve the above and other objects, there is provided a printer that includes a plurality of print hammers that are selectively driven in accordance with print data, thereby making an impression of dot on a print medium. In conjunction with each print hammer, there are provided a counter, a timer, reference value changing means, and print halting means. The counter counts a number of times a print hammer is driven. The timer repeatedly measures a predetermined period of time. The reference value changing means is provided for changing a reference value based on the number of times the print hammer is driven during a previous print phase immediately before a present print phase. Each print phase continues for the predetermined period of time measured by the timer. Here, the reference value represents an allowable number the print hammer can be driven during each of successive print phases. The print halting means is provided for halting driving of the print hammer when a number of times the print hammer is driven during the present print phase has reached the reference value changed by the reference value changing means.

Driving of the print hammer Is halted until expiration of the present print phase.

Preferably, the reference value changing means includes a counter value holding unit that holds a previous counter value Indicating a number of times the print hammer is driven during the previous print phase, a reference value changing unit that changes the reference value based on the previous counter value, and a data latch circuit that latches the reference value changed by the reference value changing unit.

The print halting means includes a comparator that compares a present counter value indicating a number of times the print hammer is driven during the present print phase with the reference value latched by the data latch circuit.

It Is preferable that the reference value changing unit change the reference value to a predetermined value M when the previous counter value is in a range from 1 to M. The predetermine value M is an integer equal to or larger than two. Also, the reference value changing unit changes the reference value to (N−1)+M when the previous counter value is equal to zero.

Because printing is carried out through successive print phases, the counter is cleared each time the predetermined period of time has expired. Also, the counter value holding unit updates the counter value each time the predetermined period of time measured by the timer is expired, that is, at the end of each of the successive print phases.

The print halting means halts driving of the print hammer from a time when the comparator indicates that the present counter value has reached the reference value latched by the data latch circuit.

In accordance with another aspect of the present invention, there is provided a method of controlling a printer including a plurality of print hammers that are selectively driven in accordance with print data, thereby making an impression of dot on a print paper. The method includes the steps of:

(a) counting a number of times a print hammer is driven:

(b) repeatedly measuring a predetermined period of time;

(c) changing a reference value based on the number of times the print hammer is driven during a previous print phase defined by the predetermined period of time before measuring a present print phase that is also defined by the predetermined period of time wherein the reference value represents an allowable number the printer hammer can be driven during each of successive print phases; and (d) halting driving of the print hammer when a number of times the print hammer is driven during the present print phase has reached the reference value changed in step (c) until expiration of the present print phase.

The step (c) includes the steps of:

(c1) holding a previous counter value indicating a number of times the print hammer is driven during the previous print phase;

(c2) changing the reference value based on the previous counter value; and (c3) latching the reference value changed in step (C2).

The step (d) includes the step of comparing a present counter value indicating a number of times the print hammer is driven during the present print phase with the reference value latched in step (c3).

In step (c2), the reference value is changed to a predetermined value M when the previous counter value is in a range from 1 to M wherein the predetermine value N is an integer equal to or larger than two, or the reference value is changed to (M−1)+M when the previous counter value is equal to zero.

BRIEF DESCRIPTION OF THE DRAWINGS

The particular features and advantages of the invention as well as other objects will become apparent from the following description taken in connection with the accompanying drawings, in which.

DETAILED DESCRIPTION OF THE PREFERRED EMBODIMENT

A preferred embodiment of the present invention will be described while referring to the accompanying drawings.

Figure 5:
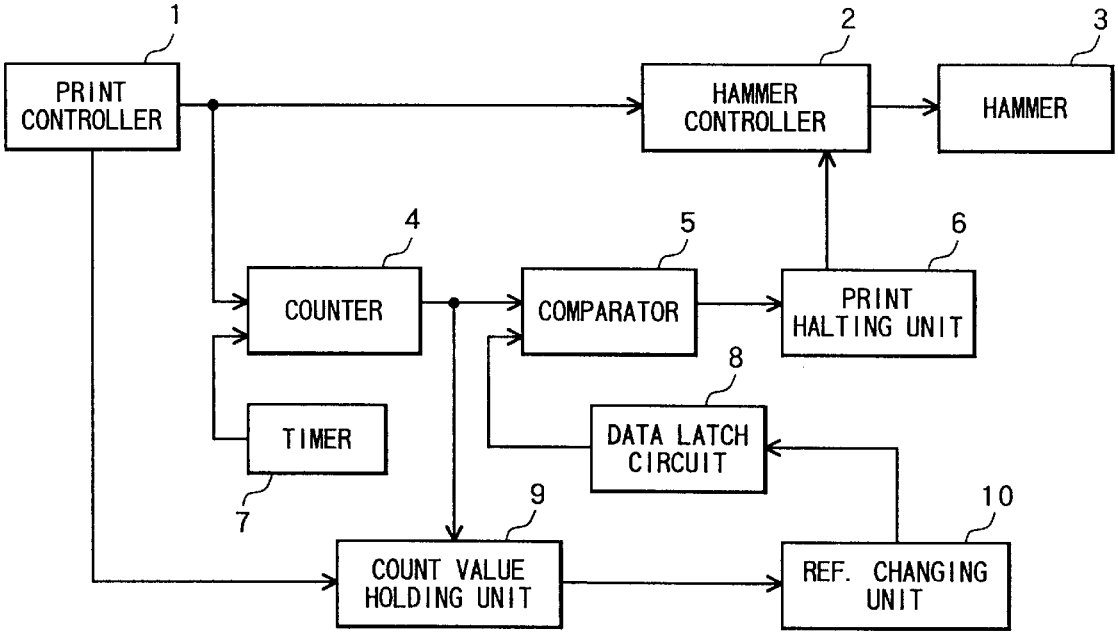
FIG. 5 is a block diagram showing a print controlling system according to one embodiment of the present invention.
Figure 6:
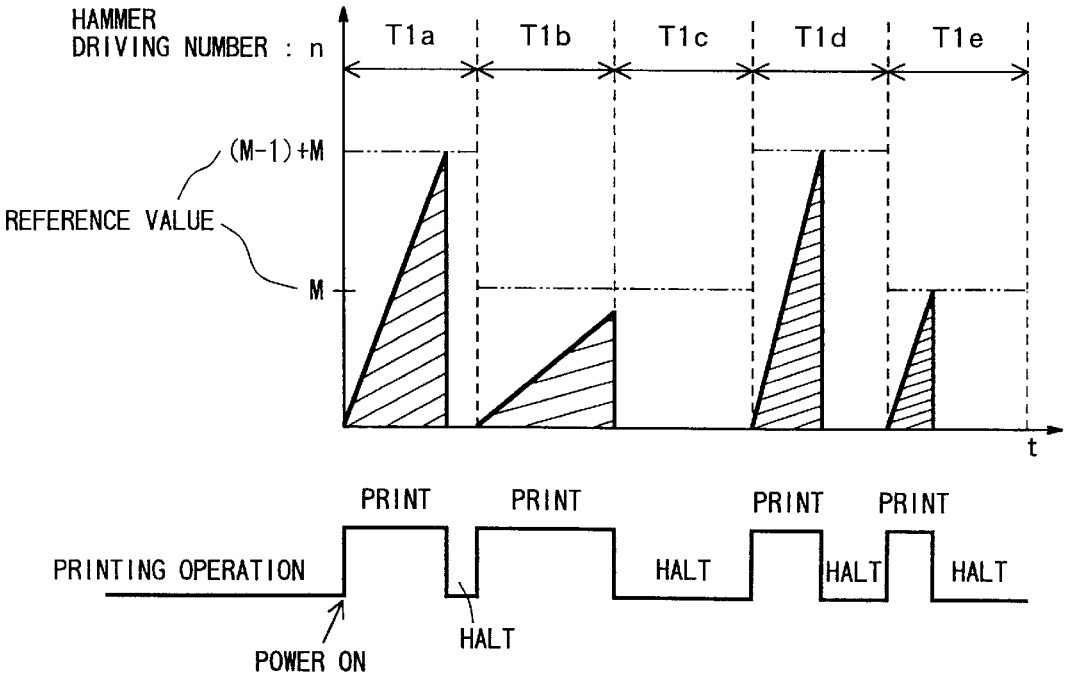
FIG. 6 is a timing chart illustrating operation of the print controlling system shown in FIG. 5.

FIG. 5 is a block diagram showing a print controlling system according to a preferred embodiment of the present invention, and FIG. 6 is a timing chart illustrating the operation of the print controlling system shown in FIG. 5.

Figure 1:
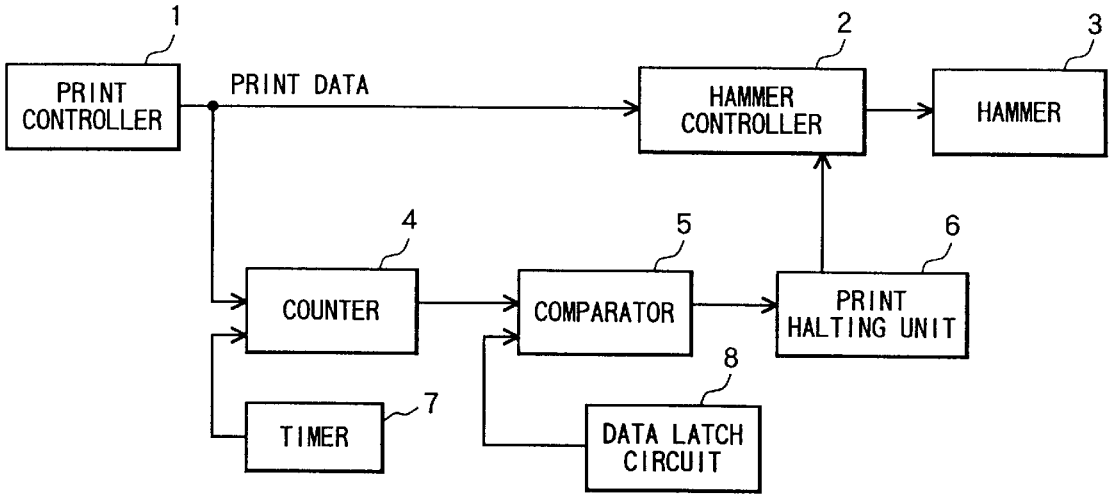
FIG. 1 is a block diagram showing a conventional print controlling system.
Figure 2:
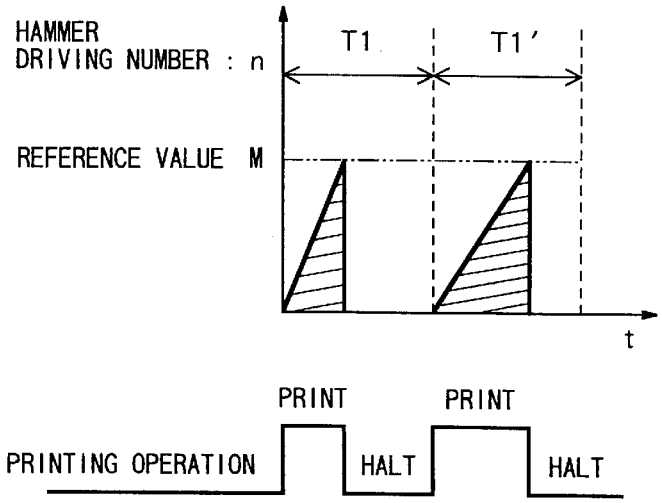
FIG. 2 is a timing chart illustrating one operational mode of the print controlling system shown in FIG. 1.
Figure 3:
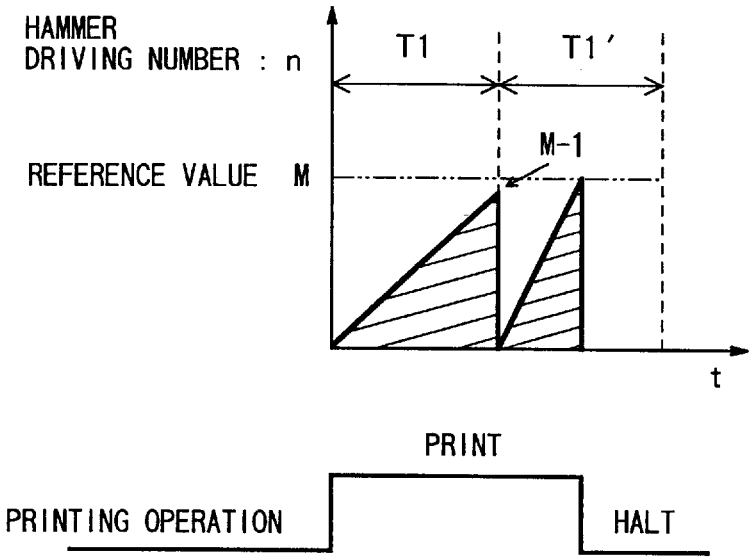
FIG. 3 is a timing chart illustrating another operational mode of the print controlling system shown In FIG. 1.
Figure 4:
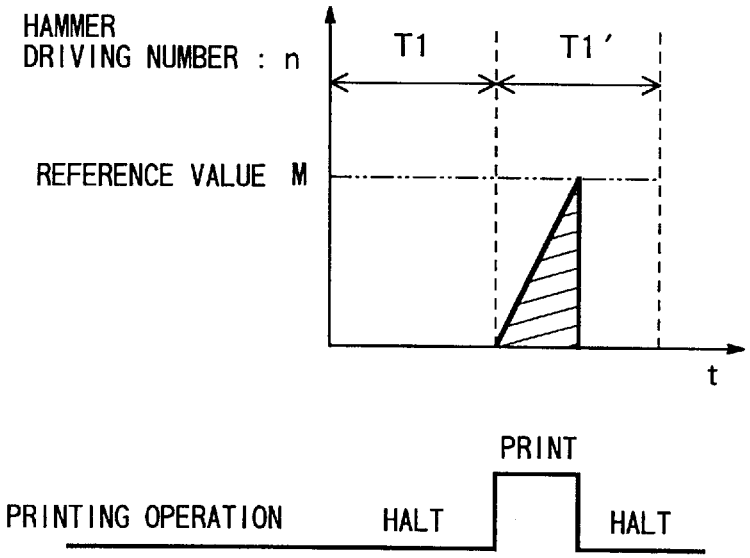
FIG. 4 is a timing chart illustrating still another operational mode of the print controlling system shown in FIG. 1.

The system shown in FIG. 5 includes print controller 1, counter 4, timer 7, comparator 5, data latch circuit 8, print halting unit 6, hammer controller 2 and hammer 3 which are identically connected to those shown in FIG. 1. Specifically, the print controller 1 is connected to the hammer controller 2 and the counter 4. The counter 4 is provided to each of a plurality of print hammers 3. The counter 4 receives the print data from the print controller 1 and counts a number of times the corresponding hammer is driven during a predetermined period of time T1 measured by the timer 7. The comparator 5 compares the count value with a reference value H stored in the data latch circuit 8. When the comparison results indicate that the count value has reached the reference value M during the predetermined period of time, then the print halting unit 6 outputs a print stop signal to the hammer controller 2. In response to the print stop signal, the hammer controller 2 stops driving the hammer 3 until the expiration of the predetermined period of time.

In the embodiment of the present invention, other than those components, a count value holding unit 9 and a reference value changing unit 10 are provided. When the counter 4 counts the number of times the hammer is driven during one print phase, the count value in this print phase is output to the count value holding unit 9 for storage. The count value holding unit 9 updates the count value each time the count value is input thereto.

The reference value changing unit 10 changes the reference value based on the count value stored in the count value holding unit 9. Specifically, when the count value holding unit 9 holds a value "0" indicating that no print hammer is driven during the previous print phase, the reference value changing unit 10 changes the reference value latched in the data latch circuit 8 to (M−1)+M. When the count value holding unit 9 holds a value equal to or more than "1" but equal to or less than (M−1). the reference value changing unit 10 changes the reference value latched in the data latch circuit 8 to M.

When the comparison results in the comparator 5 indicate that the number of times the print hammer is driven has reached the reference value set by the reference value changing unit 10, the print haling unit 6 outputs the print stop signal to the hammer controller 2 to halt driving of the hammer until the predetermined period of time measured by the timer 7 expires.

Next, referring to the timing chart shown in FIG. 6, the operation of the system shown in FIG. 5 will be described.

During a predetermined period of time T1*a* immediately after the printer is powered, the hammer has not yet been driven. Therefore, (M−1)+M is set as a reference value by the reference value changing unit 10. In this embodiment, driving of the hammer is halted when the number of times the hammer is driven during the predetermined period of time for one print phase has reached (M−1)+M. The driving of the hammer is halted until the start of subsequent print phase which also continues for the same predetermined period of time.

During the second print phase T1*b,* M is set as the reference value by the reference value changing unit 10 because in the previous print phase, the hammer is driven (M −1)+M times. During the second print phase, the number of times the hammer is driven has not reached the reference value M. Therefore, printing is continued until the end of the second print phase, that is, before the start of the third print phase.

During the third print phase Tic. M is again set as the reference value by the reference value changing unit 10 because in the second print phase, the hammer is driven. Because no print data is present for the third print phase, the hammer is not driven.

During the fourth print phase T1*d*, (M−1)+N is set as a reference value by the reference value changing unit 10 because no printing is performed during the third print phase T1*c*. Because the number of times the hammer is driven during the fourth print phase T1*d* has reached the reference value (M−1)+M, driving of the hammer is halted until the end of the fourth print phase T1*d*.

During the fifth print phase T1*e,* M is set as the reference value by the reference value changing unit 10 because in the fourth print phase, the hammer Is driven. Because the number of times the hammer is driven during the fifth print phase T1*e* has reached the reference value M, driving of the hammer is halted until the end of the fifth print phase T1*e*.

As described, the reference value to be compared with the number of times the hammer is driven during a predetermined period of time is changed based on the printing status in the previous print phase. Therefore, an optimum print control can be achieved With the present invention in which hammer components are used to show their maximum operational limit. As such, the effective printing speed will be maintained at a high speed.

While only one exemplary embodiment of this invention has been described in detail, those skilled in the art will recognize that there are many possible modifications and variations which may be may in this exemplary embodiment while yet retaining many of the novel features and advantages of the invention. Accordingly, all such modifications and variations are intended to be included within the scope of the appended claims.

What is claimed is:

1. A printer comprising:

a plurality of print hammers that are selectively driven in accordance with print data, thereby making an impression of dot on a print medium;

a counter, provided for each of said plurality of print hammers, that counts a number of times a print hammer is driven;

a timer that repeatedly measures a predetermined period of time;

reference value changing means for changing a reference value based on the number of times the print hammer is driven during a previous print phase defined by the predetermined period of time measured by said timer immediately before measuring a present print phase that is also defined by the predetermined period of time measured by said timer wherein the reference value represents an allowable number the print hammer can be driven during each of successive print phases; and print halting means for halting driving of the print hammer when a number of times the print hammer is driven during the present print phase has reached the reference value changed by said reference value changing means, driving of the print hammer being halted until expiration of the present print phase.

2. The printer according to claim 1, wherein said reference value changing means comprises:

a counter value holing unit that holds a previous counter value indicating a number of times the print hammer is driven during the previous print phase;

a reference value changing unit that changes the reference value based on the previous counter value; and a data latch circuit that latches the reference value changed by said reference value changing unit.

3. The printer according to claim 2, wherein said print halting means comprises a comparator that compares a present counter value indicating a number of times the print hammer is driven during the present print phase with the reference value latched by said data latch circuit.

4. The printer according to claim 2, wherein said reference value changing unit changes the reference value to a predetermined value M when the previous counter value is in a range from 1 to M wherein the predetermine value H is an integer equal to or larger than two.

5. The printer according to claim 4, wherein said reference value changing unit changes the reference value to (M−1) +M when the previous counter value is equal to zero.

6. The printer according to claim 2, wherein said counter is cleared each time the predetermined period of time has expired.

7. The printer according to claim 2, wherein said counter value holding unit updates the counter value each time the predetermined period of time measured by said timer is expired.

8. The printer according to claim 3, wherein said print halting means halts driving of the print hammer from a time when said comparator indicates that the present counter value has reached the reference value latched by said data latch circuit.

9. A method of controlling a printer that includes a plurality of print hammers that are selectively driven in accordance with print data, thereby making an impression of dot on a print paper, the method comprising the steps of:

(a) counting a number of times a print hammer is driven:

(b) repeatedly measuring a predetermined period of time;

(c) changing a reference value based on the number of times the print hammer is driven during a previous print phase defined by the predetermined period of time before measuring a present print phase that is also defined by the predetermined period of time wherein the reference value represents an allowable number the printer hammer can be driven during each of successive print phases; and (d) halting driving of the print hammer when a number of times the print hammer is driven during the present print phase has reached the reference value changed in step (c) until expiration of the present print phase.

10. The method according to claim 9, step (c) comprises the steps of:

(c1) holding a previous counter value indicating a number of times the print hammer is driven during the previous print phase;

(c2) changing the reference value based on the previous counter value; and (c3) latching the reference value changed in step (c2).

11. The method according to claim 10, wherein step (d) comprises the step of comparing a present counter value indicating a number of times the print hammer is driven during the present print phase with the reference value latched in step (c3).

12. The method according to claim 10, wherein in step (c2), the reference value is changed to a predetermined value M when the previous counter value is in a range from 1 to M wherein the predetermine value M is an integer equal to or larger than two.

13. The method according to claim 12, wherein in step (c2), the reference value Is changed to (M−1)+M when the previous counter value is equal to zero.

* * * * *